United States Patent [19]

Fukutsuka et al.

[11] Patent Number: 4,473,481

[45] Date of Patent: Sep. 25, 1984

[54] LUBRICANT FILM FOR PREVENTING GALLING OF SLIDING METAL SURFACES

[75] Inventors: Toshio Fukutsuka; Kazutoshi Shimogori; Kazuo Fujiwara, all of Kobe; Etsuo Yamamoto, Osaka; Keiichi Wada, Kobe, all of Japan

[73] Assignee: Kabushiki Kaisha Kobe Seiko Sho, Kobe, Japan

[21] Appl. No.: 447,634

[22] Filed: Dec. 7, 1982

[30] Foreign Application Priority Data

Apr. 14, 1982 [JP] Japan ..... 57-63119

[51] Int. Cl.[3] ..... C10M 7/52

[52] U.S. Cl. ..... 252/30; 252/12; 252/26; 252/28

[58] Field of Search ..... 252/12, 26, 28, 30

[56] References Cited

U.S. PATENT DOCUMENTS

| | | | |
|---|---|---|---|
| 3,869,393 | 3/1975 | Booker | 252/12 |
| 3,996,143 | 12/1976 | Orkin et al. | 252/12 |
| 4,256,811 | 3/1981 | Black | 252/26 |

*Primary Examiner*—Jacqueline V. Howard

*Attorney, Agent, or Firm*—Oblon, Fisher, Spivak, McClelland & Maier

[57] ABSTRACT

A lubricant film which prevents galling or sliding metal surfaces comprising: a solid lubricant comprising 60–80% wt % of $MoS_2$ or $MoS_2$+graphite; a lubricant additive comprising at least one component which comprises 10–30% wt % of $Sb_2O_3$, Fe powder Zn powder or Ag powder; and an organic binder comprising 3–15% by weight of at least one component selected from the group consisting of epoxy ester resin, acrylic resin and urea resin.

7 Claims, 6 Drawing Figures

LUBRICANT FILM FOR PREVENTING GALLING OF SLIDING METAL SURFACES

BACKGROUND OF THE INVENTION

1. Field of the Invention

This invention relates to a novel lubricant film to be formed on the surfaces of sliding metal parts under high surface pressure for preventing galling thereof.

2. Description of the Prior Art

Galling occurs to metal surfaces which are in sliding contact under high surface pressure, particularly in a case where the metal has low thermal conductivity and a large thermal expansion coefficient like stainless steel, often causing problems in various industrial machines.

For example, if the phenomenon of galling occurs when connecting threaded ends of oil well pipes, the connecting and breaking operation has to be interrupted to lift up the pipe, cutting off the defective pipe end, and tapping a fresh screw thread on the pipe end, wasting considerable time and labor. In addition to oil well pipes, the same applies to the metallic sliding parts which are subjected to a high surface pressure.

There have thus far been developed various lubricants for preventing galling of metallic sliding parts, which in most cases contain a solid lubricant, a lubricant additive and/or an organic resin. For example, a lubricant of $MoS_2$-resin system is proposed in U.S. Pat. Nos. 3,051,586, 4,303,537, 3,146,142 and 4,206,060 and Japanese Patent Publication No. 51-43558, a lubricant of $MoS_2$-$Sb_2O_3$-resin system is disclosed in U.S. Pat. Nos. 3,314,885 and 3,882,030, and Kirk-Othmer Encyclopedia of Chemical Technology, and a lubricant of graphite-resin system is described in U.S. Pat. No. 2,335,958.

In order to make the most of the functions of the component of a lubricant and to maintain satisfactory lubricative properties in severe conditions under a high surface pressure, the type of lubricant and blending ratios of the ingredients are important factors which should be taken into consideration. The lubricant of the above-mentioned systems or compositions are not necessarily satisfactory as a lubricant for sliding metal parts under high surface pressure and cannot be expected to sufficiently prevent galling.

SUMMARY OF THE INVENTION

Accordingly, it is an object of the present invention to provide a lubricant film which is capable of effectively preventing galling of sliding metallic parts under high surface pressure.

According to one aspect of the invention; there is provided a lubricant film which comprises: a solid lubricant comprising 60–80 wt % of $MoS_2$ or $MoS_2$+graphite; a lubricant additive comprising at least one component selected from the group consisting of 10–30 wt % of $Sb_2O_3$, Fe powder, Zn powder and Ag powder or a mix thereof; and an organic binder comprising 3–15% of at least one component selected from the group consisting of epoxy-ester resin, acrylic resin and urea resin or a mixture thereof.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

The lubricant film according to the present invention comprises a solid lubricant, an additive and an organic resin binder. The solid lubricant is, for example, $MoS_2$ and $MoS_2$+graphite, the lubricant additive is, for example, $Sb_2O_3$, Fe powder, Zn powder, Ag powder or a mixture thereof, and the organic resin is, for example, an epoxy-ester resin, an acrylic resin, an urea resin or a mixture thereof.

With regard to the solid lubricant, the lubricant film according to the present invention contains $MoS_2$ or $MoS_2$+graphite, as mentioned hereinbefore, in an amount of 60–80 wt %. The solid lubricant which plays the main role in lubrication lowers the friction coefficient and therefore reduces the amount of frictional heat in the sliding metal portions under high surface pressure to prevent the galling, so that it should be contained in the range of 60–80 wt %.

The solid lubricants such as $WS_2$, $(CF)_n$ (carbon fluoride), PTFE (polytetrafluoroethylene) are too low in the lubricating property, so that the solid lubricant component in the present invention is restricted to $MoS_2$ or $MoS_2$+graphite of the above defined range. A solid lubricant content less than 60 wt % will be reflected by a deteriorated durability and a high friction coefficient, and the deterioration in durability will occur even with a solid lubricant content in excess of 80 wt %. Thus, the content of the solid lubricant should be in the range of 60–80 wt %.

A lubricant additive which improves the thermal stability of the solid lubricant containing film, such as $Sb_2O_3$, Fe powder, Zn powder, Ag powder or a mixture thereof, is added in an amount of 10–30 wt %. The lubricant additive serves to suppress the oxidation of $MoS_2$ of the solid lubricant ($MoS_2$ being oxidized to $MoO_3$ which has lower lubricating property). The content of the lubricant additive should be in the range of 10–30 wt % since the above-mentioned effect cannot be expected if its content is less than 10 wt % and the lubricating property of the solid lubricant containing film is lowered if its content is greater than 30 wt %.

Figure 1:
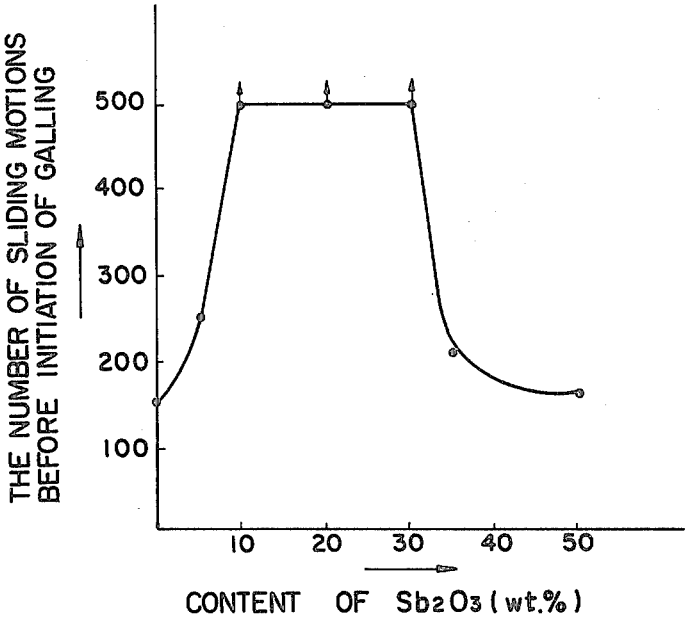
FIG. 1 is a graphic representation of the sliding time up to the occurrence of initial galling versus the $Sb_2O_3$ content.

FIG. 1 shows sliding tests of lubricant films containing an epoxy-ester resin and $MoS_2$+$Sb_2O_3$ constantly in a weight ratio of 5:95 but with variations in the content of $Sb_2O_3$. It may be readily seen that the durability of the lubricant film is improved conspicuously when the $Sb_2O_3$ content is in the range of 10–30 wt %, enduring more than 500 times of sliding motions before initiation of galling.

Examples of other lubricant additives include PbO, $MnCl_2.4H_2O$, and $AS_2O_3$. However, it will be clear from Table 1 that, except when using the lubricant additives according to the invention, galling occurs at a relatively early time point due to the unsatisfactory lubricating effect of the lubricant additive.

The organic binder, contains an epoxy-ester resin, an acrylic resin, an urea resin or a mixture thereof and is added in the range of 3–15 wt %. More particularly, the organic binder which plays the important role of binding the particles of the solid lubricant powder and the lubricant additive powder to each other as well as to the base metal surface should be contained more than 3 wt % in order to insure binding to a sufficient degree. However, its content should not exceed 15% in view of the low lubricating property of the binder itself under high surface pressure.

TABLE 1

| Sample No. | Solid Lubric't | Organic Lubric't | Lubric't Additive | Sliding Time (A) | Sliding Time (B) |
|---|---|---|---|---|---|
| 1 | $MoS_2$ | Epoxy-ester resin | $ZnSO_4.7H_2O$ | 153 | 387 |
| 2 | " | Epoxy-ester resin | $Fe_2O_3$ | 160 | >500 |
| 3 | " | Epxoy-ester resin | $MnCl_2.4H_2O$ | 370 | >500 |
| 4 | " | Epoxy-ester resin | $NaHCO_3$ | 320 | 405 |
| 5 | " | Epoxy-ester resin | $AS_2O_3$ | 201 | 305 |
| 6 | " | Epoxy-ester resin | $Bi_2O_3$ | 280 | >500 |
| 7 | " | Epoxy-ester resin | $SiO_2$ | 305 | >500 |
| 8 | " | Epoxy-ester resin | PbO | 380 | 420 |
| 9 | " | Epoxy-ester resin | $TiO_2$ | 345 | >500 |
| 10 | " | Epoxy ester resin | Cu powder | 374 | >500 |
| 11 | " | Epoxy-ester resin | Pb powder | 374 | >500 |
| 12 | " | Epoxy-ester resin | CaO | 418 | >500 |
| 13 | " | Epoxy-ester resin | Ag powder | 500 | >500 |
| 14 | " | Epoxy-ester resin | Zn powder | ≧500 | >500 |
| 15 | " | Epoxy-ester resin | Fe powder | >500 | >500 |
| 16 | " | Epoxy-ester resin | $Sb_2O_3$ | >500 | >500 |

Note:
The sliding times A and B represent an average number of sliding motions before initiation of galling and an average number of sliding motions up to a time point of abrupt increase in friction coefficient, respectively, in a sliding test which was repeated three times under the same condition.

Figure 2:
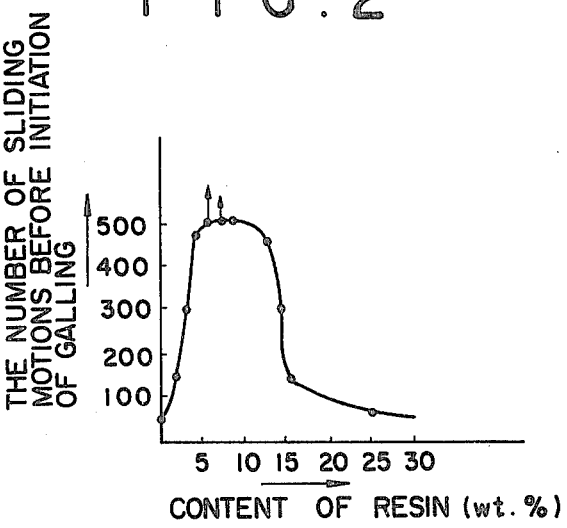
FIG. 2 is a graphic representation of the sliding time up to the occurrence of initial galling versus the resin content.

FIG. 2 graphically shows the relationship between the sliding time before initial galling and the resin content in lubricant films on sliding metal portions under high surface pressure, the lubricant films containing $MoS_2$ and $Sb_2O_3$ commonly in a ratio of 4:1 but having different resin contents. It will be seen therefrom that the lubricant film has good durability with a resin content in the range of 3–15 wt % and a higher durability with a resin content of 3.5–12 wt %, exhibiting the most preferable durability in the range of 4–8 wt %. Thus, based on a novel concept of reducing the resin content to as small an amount as possible, the invention has succeeded in developing a lubricant film suitable for sliding metal parts under high surface pressure.

Further, in consideration of the above-mentioned function of the resin binder, the particular type of binder used is regarded as an important factor which governs the durability of the lubricant film. The organic binders which are generally known in the art include phenol resins, epoxy resins+phenol resins or alkyd resins, and urethane resins. In this regard, the present invention restricts the binder to epoxy ester resins, acrylic resins, urea resins and mixtures thereof for the following reasons.

Table 2 below shows the sliding time up to the time point at which galling initially takes place, with regard to lubricant films of a $MoS_2$—$Sb_2O_3$-organic resin system formed on sliding metal portions under high surface pressure and containing different kinds of organic binders. It will be understood therefrom that acrylic resins, epoxy ester resins and urea resins which are employed in the present invention have excellent properties with regard to the durability of the lubricant film as compared with other organic binders.

Examples of acrylic resin, epoxy ester resins and urea resins useful in the present invention include, although not being limited thereto, acrylic resins such as copolymers of methylmethacrylate, ethylmethacrylate, and propylmethacrylate, and epoxy.ester resins such as epichlorhydrin-bisphenol A-type epoxy resins esterified with an unsaturated fatty acid of, for instance, linseed oil, and castor oil, and urea resins such as condensation of polymers of urea and formaldehyde.

TABLE 2

| Sample No. | Solid Lubric't | Lubric't Additive | Organic Resin | Sliding Time (1) | Sliding Time (2) |
|---|---|---|---|---|---|
| 1 | $MoS_2$ | $Sb_2O_3$ | Urethane resin | 190 | >500 |
| 2 | " | " | Epoxy-ester resin + phenol resin | 195 | 310 |
| 3 | " | " | Phenol resin | 250 | 90 |
| 4 | " | " | Alkyd resin | 325 | 470 |
| 5 | " | " | Silicon resin | 210 | 320 |
| 6 | " | " | Epoxy resin | 450 | >500 |
| 7 | " | " | Acryl resin | >500 | >500 |
| 8 | " | " | Epoxy-ester resin | >500 | >500 |
| 9 | " | " | Urea resin | >500 | >500 |

The lubricant film according to the present invention is formed on the sliding metallic parts in the following manner.

First, the respective components of the lubricant film are blended in the above-defined proportions and then mixed with an organic solvent such as toluene. The resulting suspension is applied uniformly and thinly, for example, on threaded joint portions of stainless steel pipes by a brush or a sprayer, and then the organic solvent is removed by air seasoning to form a film of the above-mentioned constituents. Although the natural seasoning is sufficient, it is preferred that the film which has been formed in this manner be thermally treated for a time period of several minutes to 5 hrs in a temperature range of 200°–300° C.

The above-described lubricant film according to the present invention exhibits good durability when applied to sliding metal parts under high surface pressure, eliminating the problem of galling which occurs when using conventional lubricants.

The lubricant film of the present invention can be applied to various sliding metal parts which are subjected to a high surface pressure for diversified purposes, for example, to stainless steel pipes to be used as oil well pipes. Although grease (thread compounds) is usually applied to the threaded ends of such pipes before joining them end to end, some parts of the threaded end portions are subjected upon tightening to a surface pressure close to the yield stress of stainless steel (e.g., 70 kg/mm$^2$) with the trouble of galling as mentioned hereinbefore. However, the tightening and breaking of the threaded joint portions with the lubricant film of the present invention can be performed smoothly and free of galling problems. Additionally, the use of the above-mentioned grease which is applied to the threaded joint portions of the stainless pipes in the conventional pipe joining operations poses the possibility of contamination with muddy water or sea water depending upon the environment in which it is used. The lubricant film of the present invention maintains good lubricant properties and exhibits high durability even in such severe environments.

Having now generally described this invention, the same will be better understood by reference to the following specific examples, which are included for purposes of illustration only and are not intended to be limiting thereof.

EXAMPLE 1

Figure 3:
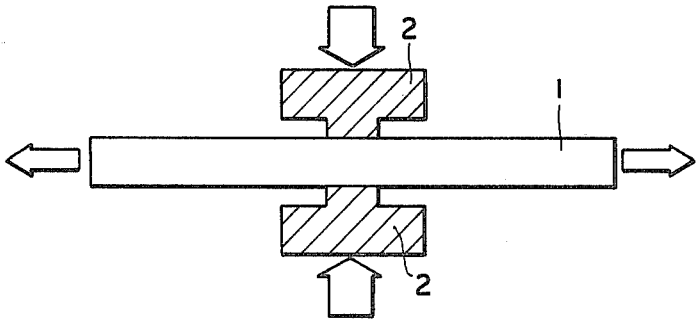
FIGS. 3 to 5 are schematic views of a platerider friction test apparatus.
Figure 4:
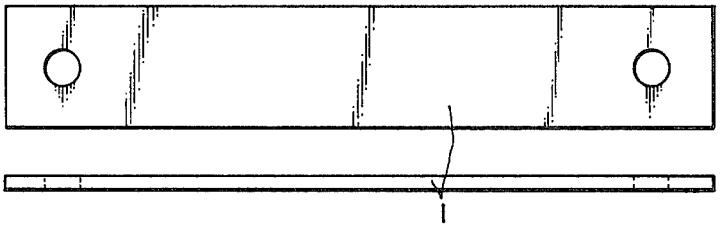
Figure 5:
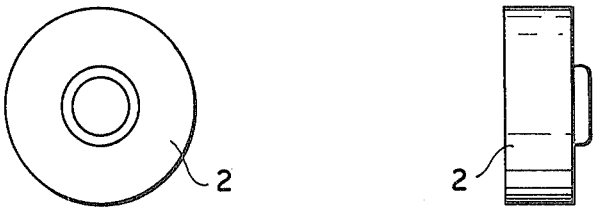

Lubricant compositions were prepared containing $MoS_2$, $Sb_2O_3$ and an epoxy-ester resin in the ratios of 52 wt %: 13 wt %: 35 wt % (No. 1), 72 wt %: 18 wt %: 10 wt % (Nos. 2) and 76 wt %: 19 wt %: 5 wt % (No. 3), respectively, and, after mixing with an organic solvent, each suspension was applied on plate 1 of the testing apparatus as shown in FIGS. 3 to 5. After natural seasoning, the resulting film was subjected to a plate-rider friction test, in which an apparent contact load of 100 kg/mm$^2$ was imposed on plate 1, a test piece of SUS 410, by rider 2.

In the test shown in FIG. 3, the sliding duration was measured by counting the number of one-way sliding motion of plate 1 in the leftward or rightward direction from one end to the other end (over a distance of 60 mm) at a sliding speed of 30 mm/sec.

Figure 6:
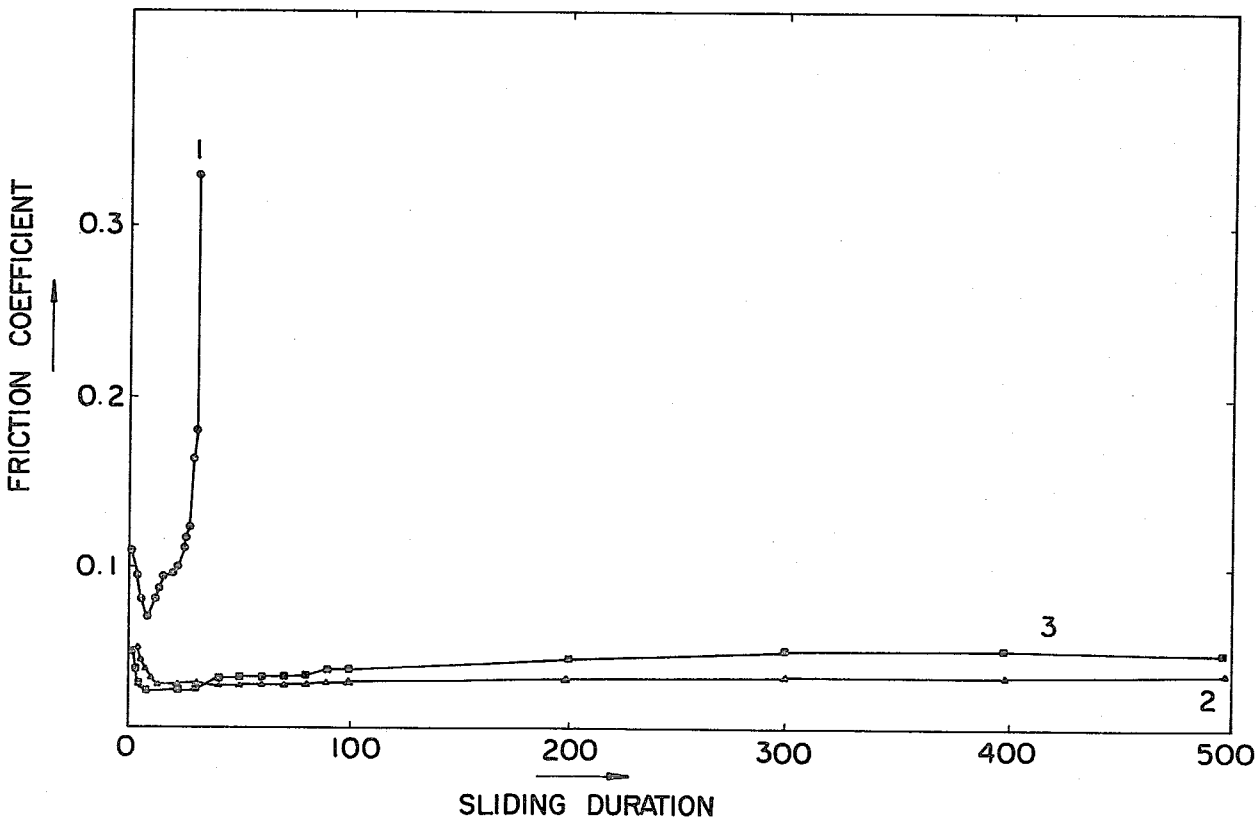
FIG. 6 is a diagram of the number of the sliding time versus the friction coefficient for various lubricants.

FIG. 6 shows the test results, wherein it may be seen that lubricant film No. 1, outside the range of the present invention, endured only about 30 sliding motions before initiation of galling, showing an abrupt increase in friction coefficient thereafter. On the other hand, the test pieces with the lubricant film Nos. 2 and 3 according to the present invention were completely free of galling even after 500 sliding motions, proving good durability of the films.

What is claimed as new and desired to be secured by Letters Patent of the United States is:

1. A lubricant film for preventing galling of sliding metal parts under high surface pressure, which consists essentially of:

a solid lubricant comprising 60–80 wt % of $MoS_2$ or $MoS_2$+graphite;

a lubricant additive comprising at least one component selected from the group consisting of 10–30 wt % of $Sb_2O_3$, Fe powder, Zn powder and Ag powder; and an organic binder comprising 3–15% of one or more organic binders selected from the group consisting of an epoxy-ester resin, acrylic resin and urea resin, or a mixture thereof.

2. The lubricant film as set forth in claim 1, wherein said organic binder comprises 3.5–12 wt %.

3. The lubricant film as set forth in claim 2, wherein said organic binder comprises 4–8 wt %.

4. A method for preventing galling of a sliding metal part under high surface pressure, comprising the steps of:

mixing with an organic solvent, a lubricant film composition consisting essentially of 60–80 wt % of a solid lubricant which comprises $MoS_2$ or $MoS_2$+-graphite, 10–30 wt % of a lubricant additive comprising one or more lubricant additives selected from the group consisting of $Sb_2O_3$, Fe powder, Zn powder, Ag powder or a mixture thereof, and 3 to 15 wt % of an organic binder comprising one or more organic binders selected from the group consisting of epoxy-ester resins, acrylic resins, urea resins or a mixture thereof, thereby forming a suspension;

applying said suspension to the surface of said sliding metal part; and drying the applied suspension by natural seasoning to remove said organic solvent, thereby forming a lubricant film on said sliding metal part.

5. The method as set forth in claim 4, wherein said lubricant film formed on said sliding metal part is thermally treated for a time period of several minutes to 5 hrs. in a temperature range of 200°–300° C.

6. A stainless steel oil well pipe having threaded joint portions thereof coated with a lubricant film which consists essentially of 60–80 wt % of a solid lubricant comprising $MoS_2$ or $MoS_2$+graphite, 10–30 wt % of a lubricant additive comprising $Sb_2O_3$, Fe powder, Zn powder, Ag powder or a mixture thereof, and 3–15 wt % of an organic binder comprising an epoxy-ester resin, an urea resin, an acrylic resin or a mixture thereof.

7. A lubricant film for preventing galling of sliding metal parts under high surface pressure which consists essentially of:

a solid lubricant comprising 60–80 wt % of $MoS_2$;

a lubricant additive comprising 10–30 wt % of $Sb_2O_3$; and a organic binder comprising 3–15% of one or more oranic binders selected from the group consisting of epoxy-ester resin, acrylic, and urea resin, or a mixture thereof.

* * * * *